US005078523A

United States Patent [19]

McGourty et al.

[11] Patent Number: 5,078,523

[45] Date of Patent: Jan. 7, 1992

[54] TAPE CASSETTE WITH IDENTIFYING CIRCUIT ELEMENT FOR PRINTING MACHINE

[75] Inventors: Thomas K. McGourty; Lawrence F. McGourty, both of Paso Robles; Kevin B. McGourty, Cardiff by the Sea, all of Calif.

[73] Assignee: Varitronic Systems, Inc., Minneapolis, Minn.

[21] Appl. No.: 440,411

[22] Filed: Nov. 17, 1989

Related U.S. Application Data

[63] Continuation of Ser. No. 163,983, Mar. 4, 1988, abandoned.

[51] Int. Cl.[5] ..... B41J 15/02

[52] U.S. Cl. ..... 400/613; 400/207; 400/249

[58] Field of Search ..... 400/174, 175, 207 E, 400/208, 613, 692, 703, 704, 249

[56] References Cited

U.S. PATENT DOCUMENTS

| | | | |
|---|---|---|---|
| D. 283,628 | 4/1986 | Hagiwara | D18/13 |
| 1,090,128 | 3/1914 | Avers | 400/249 |
| 3,545,004 | 12/1970 | Alden | 400/613 |
| 3,604,549 | 9/1971 | Caudhill et al. | 400/208 |
| 3,632,052 | 1/1972 | Read | 400/219.3 |
| 3,643,779 | 2/1972 | Anderson et al. | 400/208 |
| 3,804,227 | 4/1974 | Cappotto et al. | 400/208 |
| 3,814,231 | 6/1974 | Cappotto | 400/208 |
| 3,894,507 | 7/1975 | Koechlin | 242/57 |
| 3,994,383 | 11/1976 | Best | 400/196.1 |
| 4,000,804 | 1/1977 | Zaloeri | 400/219.3 |
| 4,140,407 | 2/1979 | Porterfield et al. | 400/216.6 |
| 4,145,146 | 3/1979 | Ohkawara et al. | 400/614 |
| 4,210,403 | 7/1980 | Mazouet et al. | 400/196.1 |
| 4,239,399 | 12/1980 | Johnstun | 400/613 |
| 4,402,619 | 9/1983 | Paque et al. | 400/613 |
| 4,407,593 | 10/1983 | Haftmann | 400/249 |
| 4,413,919 | 11/1983 | Applegate et al. | 400/208 |
| 4,419,175 | 12/1983 | Bradshaw et al. | 156/554 |
| 4,468,139 | 8/1984 | Hattori | 400/120 |
| 4,475,829 | 10/1984 | Goff | 400/225 |
| 4,496,955 | 1/1985 | Maeyama et al. | 400/208 |
| 4,557,617 | 12/1985 | Richardson et al. | 400/208 |
| 4,636,097 | 1/1987 | Goubeaux | 400/249 |
| 4,663,637 | 5/1987 | Saiton | 400/208 |
| 4,673,304 | 6/1987 | Lin et al. | 400/208 |
| 4,678,353 | 7/1987 | Richardson | 400/219.1 |
| 4,679,953 | 7/1987 | Sone et al. | 400/208 |
| 4,685,818 | 8/1987 | Kazarian | 400/249 |
| 4,700,791 | 10/1987 | Iwasaki et al. | 400/613 |
| 4,710,044 | 12/1987 | Ackermann | 400/208 |
| 4,741,634 | 5/1988 | Nozaki | 400/175 |
| 4,747,716 | 5/1988 | van der Eikel | 400/249 |
| 4,765,765 | 8/1988 | Futakata | 400/613 |
| 4,797,018 | 1/1989 | Hofmann et al. | 400/249 |
| 4,872,027 | 10/1989 | Buskirk et al. | 400/175 |

FOREIGN PATENT DOCUMENTS

| | | | |
|---|---|---|---|
| 105136 | 11/1984 | European Pat. Off. | 400/196.1 |
| 2157919 | 6/1973 | Fed. Rep. of Germany | 400/216.3 |
| 74181 | 5/1982 | Japan | 400/249 |
| 55277 | 4/1983 | Japan | 400/613 |
| 58887 | 4/1985 | Japan | 400/249 |
| 125685 | 7/1985 | Japan | 400/208 |
| 210489 | 10/1985 | Japan | 400/249 |
| 240486 | 11/1985 | Japan | 400/249 |
| 16876 | 1/1986 | Japan | 400/120 |
| 68276 | 4/1986 | Japan | 400/208 |
| 162375 | 7/1986 | Japan | 400/249 |
| 229586 | 10/1986 | Japan | 400/249 |
| 800638 | 8/1958 | United Kingdom | 400/208 |
| 1455915 | 11/1976 | United Kingdom | 400/208 |

OTHER PUBLICATIONS

"Low Cost Cartridge Code Detector", IBM Bulletin, vol. 25, No. 4, pp. 1980–1981, 9/82.

"Ribbon Drive", Darwin, *IBM Tech Disc Bull*, vol. 19, No. 4, pp. 1467–1468, Sep. 1976.

*Primary Examiner*—David A. Wiecking

*Attorney, Agent, or Firm*—Merchant, Gould, Smith, Edell, Welter & Schmidt

[57] ABSTRACT

A printing machine is disclosed for printing an image on an image receiving tape. The present invention includes a novel tape cassette. The cassette includes a housing with a tape spool and ribbon spool disposed within the housing, and electrical circuit elements which are disposed to electrically engage electrical connectors carried by the printing machine. The circuit elements are selected to cooperate with the circuitry of the printing machine to indicate desired characteristics of the cassette. The desired characteristics may be varied such that the electrical elements identify the size of the tape or the type of tape carried by the casette.

17 Claims, 10 Drawing Sheets

FIG. 11
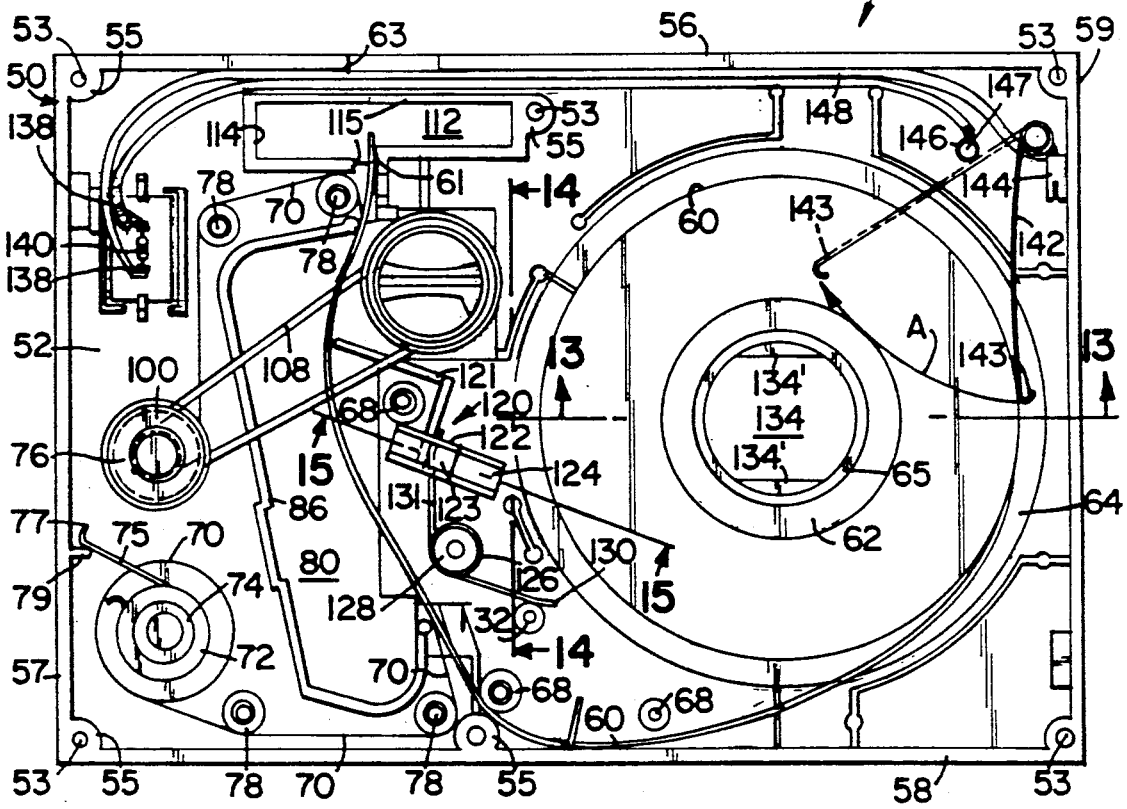
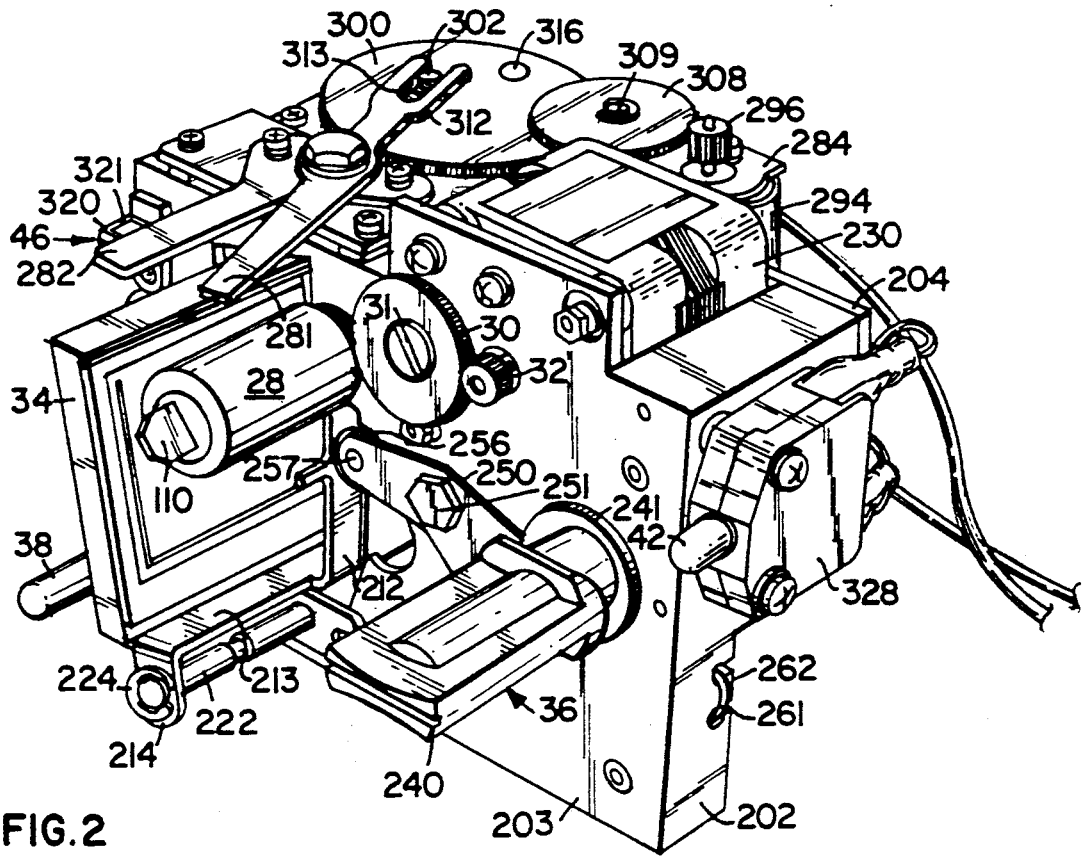
FIG. 2

240
36
246
242
244
247
251
257
256
250
254
31
30
110
28
224
225
38
276
270
272
274
271
277
275
267
273
39
221
205
226
200
252
202
243
203
33
262
42
328
329
329
233
32
269
297
315
317
314
284
280
282
280
285
281
288
289
285
312
313
316
300
303
302
309
308
310
294
296
295
237
230
231
24
221'
204
243
227
228
206
47
320
46
321
332
260'
260
261
224
212
225
214
208
225
X
210
215
211
215
34
222
216
224
219
218

TAPE CASSETTE WITH IDENTIFYING CIRCUIT ELEMENT FOR PRINTING MACHINE

This is a continuation, of application Ser. No. 07/163,983, filed Mar. 4, 1988, now abandoned.

CROSS REFERENCE TO RELATED APPLICATION

This application pertains to subject matter disclosed in commonly assigned and copending U.S. patent application Ser. No. 163,989, filed concurrently herewith, entitled "Head Control For Thermal Printing Machine" and now abandoned.

BACKGROUND OF THE INVENTION

1. Field of the Invention

This invention pertains generally to printing or typing equipment involving the use of a direct thermal printing process or thermal transfer process to transfer a dry film impression onto an image carrying tape. More particularly, this invention pertains to a novel cassette for carrying the tape.

2. Background of the Invention

In the field of commercial art, there is a significant need for simple means for transferring prefabricated letters or characters to a "paste-up" sheet for later photographing and printing. The earliest technology involving letter transfers was that of dry rub-on transfer sheets which had a series of characters preprinted thereon. These materials, however, are limited by the number of characters available on the sheet and must be very carefully aligned to produce acceptable images. Machines were later developed which printed such letters on a continuous adhesive tape. The first such machines employed print disks having raised characters. Such machines used impact printing to transfer pigment to a carrier tape. Some machines were keyboard driven while others were manual "spin and print" machines. See, for example, U.S. Pat. No. 3,912,064; 4,243,333; 4,462,708 and 4,579,056.

The impact printing machines mentioned above had many advantages over the rub-on letters, but still suffered from certain limitations. Specifically, these machines were necessarily complicated, heavy and relatively slow since the printing effect was accomplished by using physical force against the type face with the print media and pigment ribbon in between. Such machines were also restricted to pigment transfer of some form. In addition, an expensive type disk had to be molded for every point size, type style and language, leading to enormous costs in creating a suitable library. Certain foreign languages which are written either right to left or vertically, would require very specialized type disks. Speed was further limited because the type disks had to physically move to a new location to print each successive character. Finally, the resulting output was generally not considered smear proof and would have to be further coated if used in areas where frequent contact with the print surface was anticipated.

Thermal transfer printing, such as that known in inexpensive portable typewriters (for example Canon Typestar 5 TM, etc.), employed a new technology which used a heat generating print head to melt a wax-pigment from a carrier ribbon to a receiving tape. By using digital technology, characters could be formed of a sequence of pixels and print disks were not required. A related technology is direct thermal printing where an image is created on a thermally sensitive receiving paper directly by the head without the use of an intermediate carrier ribbon.

Thermal transfer has been applied in commercial art printing machines. Such a machine is marketed under the registered trademark Merlin Express® by Varitronics, Inc., assignee of the present invention. The Merlin Express® is the subject matter of co-pending and commonly assigned U.S. patent application Ser. Nos. 934,644 (now U.S. Pat. No. 4,815,871) and 934,650 (abandoned and refiled as 289471, which we abandoned and refiled as 584436) filed Nov. 25, 1986 which are continuation-in-part applications of U.S. patent application Ser. Nos. 931,430 and 931,303, both now abandoned, respectively. Likewise, the Merlin Express® is the subject matter of a design patent application filed under Ser. No. 931,631 on Nov. 17, 1986 issued 4/17/90 as patent D307,296. A font module for use in the Merlin Express® is the subject matter of U.S. patent application Ser. No. 119,810 filed Nov. 12, 1987, now abandoned.

The Merlin Express® employs a tape cassette (referred to as a cartridge in the aforementioned patent applications) which carries both an image receiving tape and an image carrying ribbon. The image receiving tape is carried on a spool housed in the cassette. The image carrying ribbon is likewise carried on a spool housed in the cassette. The image carrying tape is guided from its spool to a free end. A take-up spool is provided within the cassette for winding up the image carrying ribbon as it is utilized. The tape and ribbon are disposed so that in at least a predetermined location they are in face-to-face alignment. At the predetermined location, the cassette includes an opening which receives a transfer head and a platen when the cassette is mounted on the printing machine. The opposing tape and ribbon are disposed between the platen and the head. A gear mechanism within the head control apparatus urges the platen and head into close abutting relation with the tape and ribbon captured between them. Circuitry in the printing machine drives the platen to advance the tape and ribbon. When a desired character is inputted by an operator, the electronics of the machine energizes pixels on the thermal transfer head as the tape and ribbon advance past the head. When a command to print a letter is given a step motor actuates the platen. The head pixels are variously energized to imprint the letter on the tape.

In a printing machine such as the Merlin Express®, the machine is limited in that only a particular width of tape can be used. Also, the amount of thermal energy which is needed to effect the transfer at the pixels preferably varies from one type of tape and pigment to another. For example, it may be desirable to transfer a white pigment onto a clear or black tape. Alternatively, it may be desirable to transfer a black pigment onto either a clear or a white tape. Due to variations in types of pigments and tapes, the optimum amount of energy to effect this transfer will vary with the types of tapes and ribbons being used. Likewise, it would be desirable for the machine to be able to sense numerous characteristics related to a cassette (size, density, type, etc.) by mere insertion of the cassette into the machine. However, heretofore, a printing machine was incapable of distinguishing such complex criteria without human intervention.

SUMMARY OF THE INVENTION

According to a preferred embodiment of the present invention, a printing machine is provided for printing an image on an image-receiving tape. The present invention includes a novel tape cassette. The cassette includes a housing and a first spool disposed within the housing and carrying an image-receiving tape. A second spool is disposed within the housing and carries an image-carrying ribbon. The tape and ribbon are guided along predetermined pathways within the housing with the pathways selected for the ribbon and tape to oppose one another in a predetermined location within the cassette. The predetermined location is selected to be adjacent a transfer head when the cassette is mounted on a printing machine in a predetermined position. A drive coupler is carried by the cassette and cooperates with a drive carried by the machine to advance the tape and ribbon upon operation of the machine drive. The cassette includes electrical circuit elements which are disposed to electrically engage exposed electrical connectors carried by the printing machine. The circuit elements are selected to cooperate with the circuitry of the printing machine to indicate desired characteristics of the cassette. In the preferred embodiment, the desired characteristics may be varied such that the electrical elements identify the size of the tape or the type of tape carried by the cassette.

BRIEF DESCRIPTION OF THE DRAWINGS

FIG. 2 is a perspective view of a head control apparatus of the printing machine of FIG. 1;

FIG. 11 is a top plan view of a cassette of the present invention showing an upper cover plate removed;

DESCRIPTION OF THE PREFERRED EMBODIMENT

1. General Description

Figure 1:
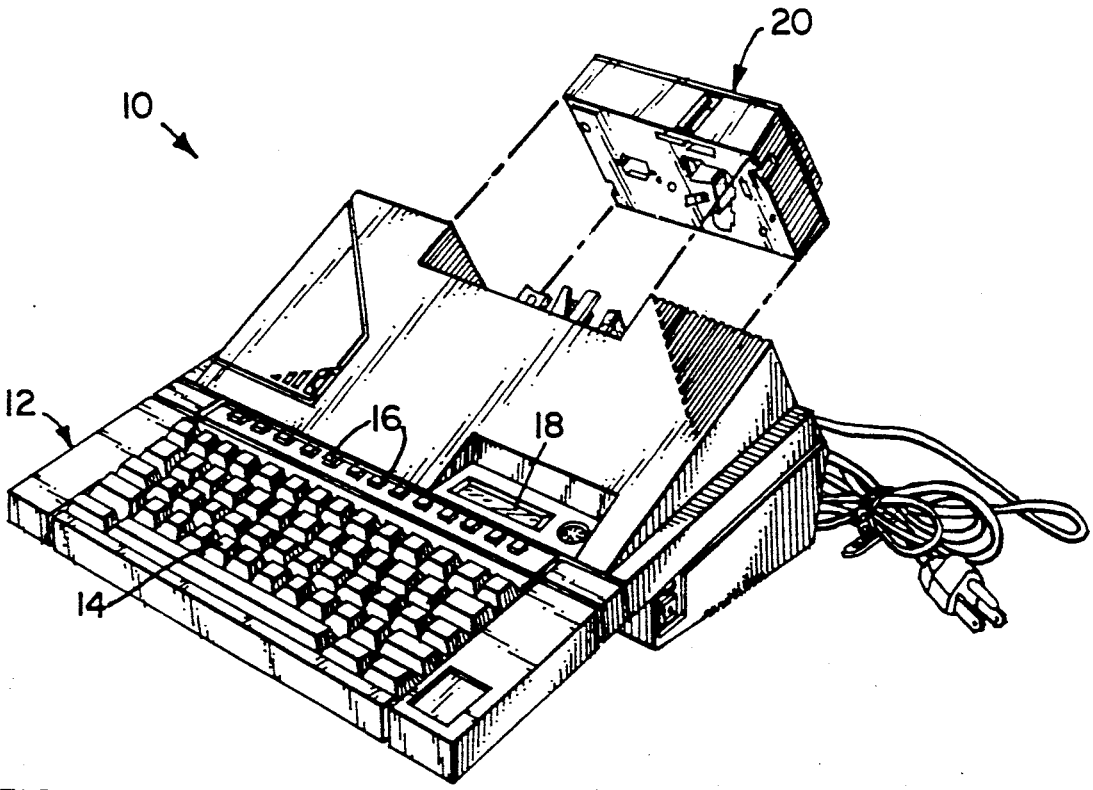
FIG. 1 is a perspective view of a printing machine incorporating the present invention.

Referring to the several figures in which like elements are identically numbered throughout, the preferred embodiment of the present invention will now be described. With initial reference to FIG. 1, a printing machine 10 is shown together with an associated tape cartridge 20. The printing machine 10 includes a keyboard portion 12 having a plurality of operator engageable keys 14. The keyboard also includes a plurality of control keys 16. The printing machine 10 further includes a user readable screen 18 to enable an operator to view a message as it is being keyed as well as other messages which may be presented by the machine 10 such as prompts and the like.

In using the machine 10, an operator selects a desired mode of operation and inputs a message through keys 14 in order to produce a tape having the desired message imprinted on the tape. The machine includes electronics (not shown) for accepting the keyed inputs and processing the inputs to generate a desired output. The desired output affects such devices as a thermal head, a tape advance motor and a tape termination blade, all of which will be described. It will be appreciated that the electronics and keyboard mechanism, as well as display screen 18, do not form any part of this invention per se and are shown and discussed solely for purposes of background and illustration to enable the reader to understand the interaction of the novel cassette 20 and novel head control apparatus in the preferred embodiment.

Figure 4:
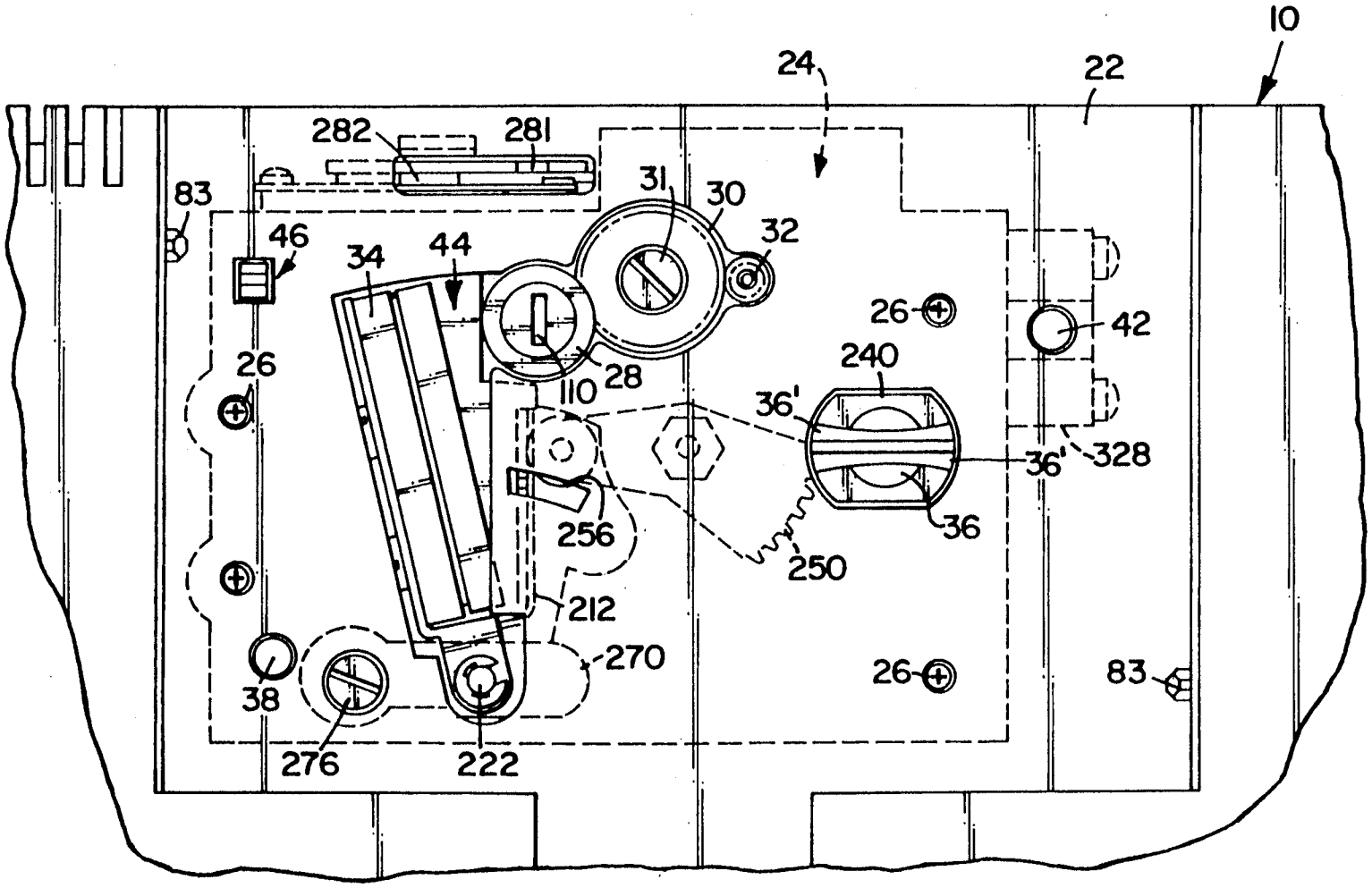
FIG. 4 is a top plan view of a cassette receiving area of the printing machine of FIG. 1.
Figure 5:
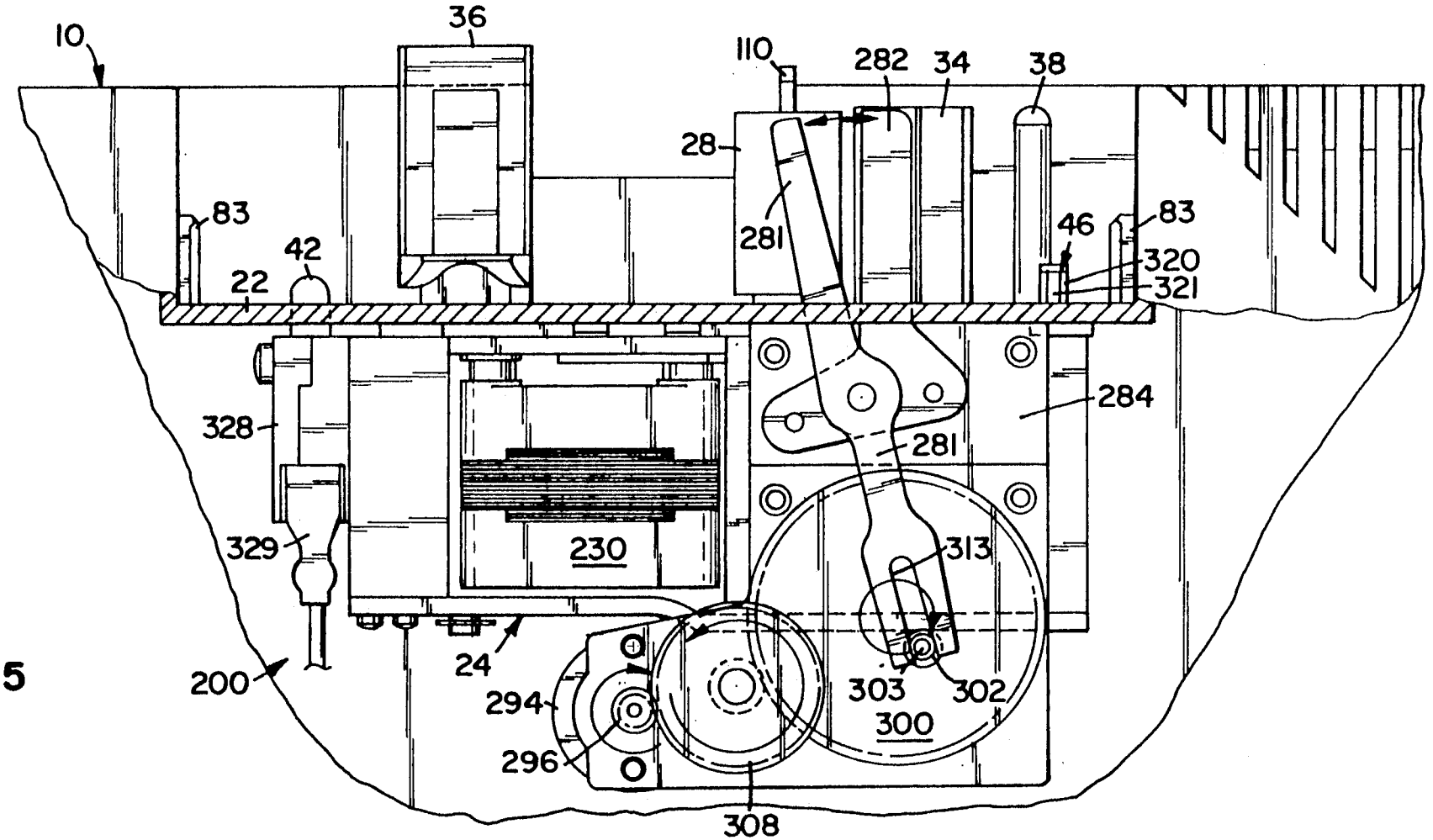
FIG. 5 is a side view taken in elevation (partially exposed) showing the cassette receiving area of the printing machine of FIG. 1.

With reference to FIGS. 4 and 5, the cassette receiving area of the printing machine 10 is shown with a tape cassette removed thereby exposing a machine plate 22 on which cassette 20 rests in operation. With cassette 20 removed, a head control apparatus 24 is shown disposed beneath plate 22. Head control apparatus 24 is secured to the underside of plate 22 by a plurality of screws 26.

While head control apparatus 24 will be described in greater detail elsewhere, in the views of FIGS. 4 and 5, it can be seen that various elements of head control apparatus 24 protrude through openings in plate 22. These exposed elements include a platen 28, a platen idler gear 30 and a step motor drive gear 32. The exposed elements further include a thermal transfer head 34, a cassette lock 36, a cassette guide pin 38, stationary and fixed knife blades 282, 281 and a switch push button 42. The exposed elements of apparatus 24 also include electrical connector 46 having exposed electrical contact elements 32 disposed on opposite side of a dielectric post 320 (shown in FIG. 2).

As shown in FIGS. 4 and 5, platen 28 and thermal head 34 oppose one another. In the view of FIG. 4, the platen 28 and thermal head 34 are shown in their first positions (as shall be more fully described) with platen 28 and thermal head 34 spaced apart to define a path 44 therebetween. Pathway 44 is intended to receive a tape and ribbon. To facilitate understanding of the apparatus, detailed discussion of the head control apparatus 24 will now be deferred pending a more complete description of cassette 20.

2. Detailed Description of Cassette 20

With primary reference to FIGS. 9-16, tape cassette 20 is shown as including a generally rectangular shaped housing 50 defined by a flat lower plate 52 and a spaced apart upper plate 54. Lower plate 52 and upper plate 54 are joined by side walls 56 and 58 and end walls 57 and 59. The side walls and end walls 56–59 are integral with the lower plate 52 and cooperate to define a housing interior. The top and bottom plates 52 and 54 are joined with pins 53 of the top plate 54 received within aligned hollow posts 55 of the bottom plate 52. Side wall 56 includes a tape outlet 63. This construction is generally the same as that shown in U.S. patent applications Ser. Nos. 934,644 and 934,650.

Figure 13:
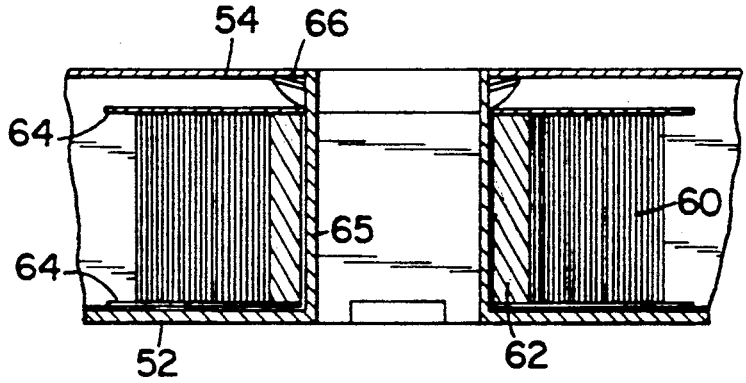
FIG. 13 is a view taken along lines XIII—XIII of FIG. 11.

An image-receiving tape 60 is disposed within the housing and includes a first tape spool 62 rotatably mounted on a cylindrical hub 65. The cylindrical hub 65 is best shown in FIG. 13 and is integral with bottom plate 52 and extends upwardly therefrom toward upper plate 54. Plastic disks 64 are disposed on opposite sides of the spool 62 and protect edges of the tape 60 during operation of the cassette 20. The disks 64 reduce friction and help prevent adhesive of the tape 60 from sticking to the housing. A cylindrical spring 66 (shown in FIG. 13) surrounds cylindrical hub 65 and urges the tape spool 62 downwardly toward bottom plate 52. The tape 60 is guided by a plurality of guide rollers and guide pins 68 to a tape free end 61.

An image-carrying ribbon 70 is provided within the housing and includes a second spool 72 mounted on a cylindrical hub 74 extending upwardly from bottom plate 52. A take-up spool 76 is also provided within the housing. The image-carrying ribbon 70 is guided by a plurality of guide pins and rollers 78 such that the tape 70 is carried from second spool 72 to take-up spool 76. A brake 75, in the form of a spring, is provided and entrained around spool 72 with a free end 77 abutting a protrusion 79 on end wall 57. Brake 75 prevents free or runaway rotation of spool 72.

Figure 16:
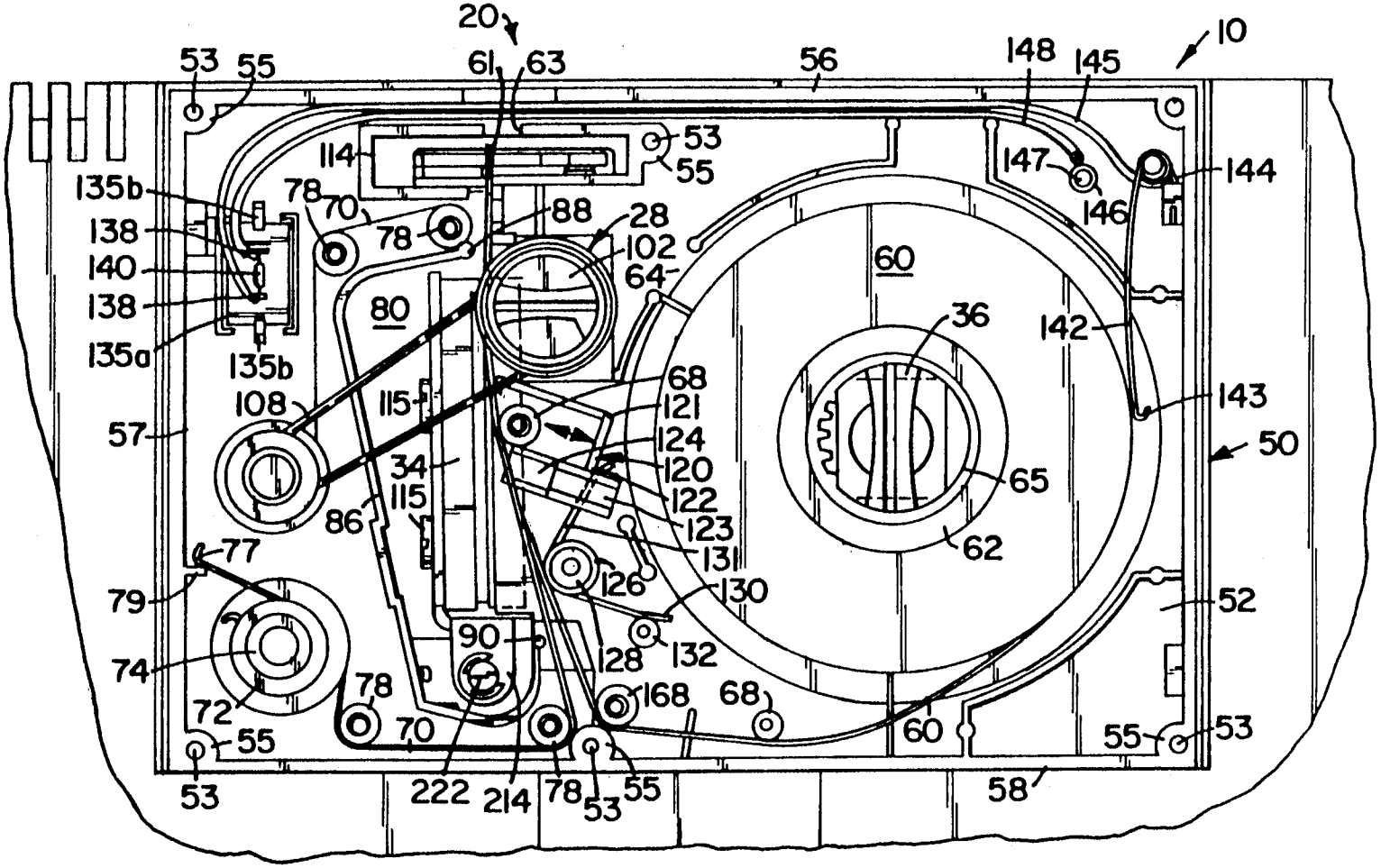
FIG. 16 is the view of FIG. 11 with the cassette installed on a printing machine with a head control apparatus in the position of FIG. 7.

Lower plate 52 includes an opening 80 positioned and sized to receive thermal transfer head 34 and platen 28 when cassette 20 is secured to printing machine 10 in a predetermined position (as shown in FIG. 16). To insure proper alignment of cassette 20 with printing machine 10, the lower plate 52 includes off-set notches 82 (shown in FIG. 12) which are sized to receive offset posts 83 (shown in FIG. 4) projecting from the machine 10. Also, bottom plate 52 includes a guide pin hole 86 (shown in FIG. 12) disposed to receive guide pin 38 to insure proper alignment of the cassette on machine 10.

Referring to FIGS. 11 and 16, a wall 86 is provided partially surrounding opening 80. The wall extends from lower plate 52 toward upper plate 54 and terminates at arcuate ends 88 and 90. Ends 88 and 90 are disposed such that the image-carrying ribbon 70 extends between posts 88 and 90 as does the image-receiving tape 60. The portions of the image-receiving tape 60 and image-carrying ribbon 70 extending between posts 88 and 90 are in face-to-face alignment. The space between the portion of tape 60 between posts 88 and 90 and the wall 86 defines a volume sized to receive the thermal transfer head 34.

Figure 14:
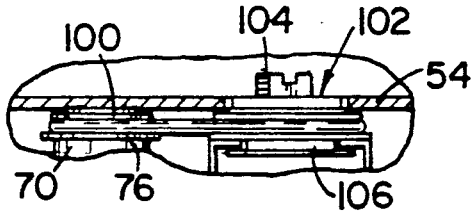
FIG. 14 is a view taken along lines XIV—XIV of FIG. 11.
Figure 15:
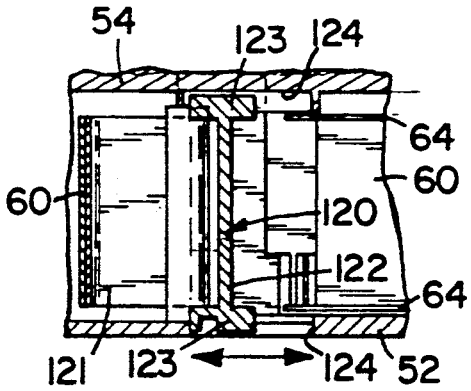
FIG. 15 is a view taken along lines XV—XV of FIG. 11.

The take-up spool 76 includes a pulley end 100 (best illustrated in FIG. 14). A drive sprocket 102 is mounted on a mounting bracket 103. The drive sprocket 102 includes finger grip 104 which extends upwardly and through upper plate 54. The opposite end of the sprocket 102 includes a female attachment end 106 (shown in FIG. 12) configured to receive a drive tab 110 which extends axially from platen 28. With tab 110 received within attachment end 106 as platen 28 rotates, drive sprocket 102 rotates. Drive belt 108 extends between pulley end 100 and sprocket 102 such that take-up spool 76 is rotated upon action of the platen 28.

The bottom plate 52 of cassette 20 defines an opening 112 (shown in FIG. 12) which is sized to receive knife blades 281, 282. Within housing 50, opening 112 is surrounded by walls 114 (see FIG. 11) having openings 115 which act as outlet for the tape free end 61.

The tape cassette 20 includes a biasing member 120 for biasing tape 60 away from platen 28. The biasing member 120 is shown most clearly in FIGS. 11, 15 and 16. The member 120 includes a biasing arm 121 and a body 122 connected thereto. Body 122 terminates at spaced apart hubs 123 which are received within aligned slots 124 formed within upper and lower plates 52, 54. Accordingly, body 122 and member 121 are slidable as the body slides within the slots 124. Member 121 pushes tape 60 away from platen 28 when the thermal transfer head is rotated to a second position (as will be described) with the head 34 rotated away from platen 28. When the thermal transfer head 34 is rotated toward its first position (as shown in FIG. 16) with the transfer head abutting platen 28, the thermal transfer head 34 urges biasing member 120 away from its position depicted in FIG. 11 and to the position of FIG. 16. To bias the biasing member 120 to the position shown in FIG. 11, a spring 126 is provided carried on a post 128 with a free end 130 of the spring abutting a fixed post 132 and a second end 131 of the spring abutting body member 122.

Figure 12:
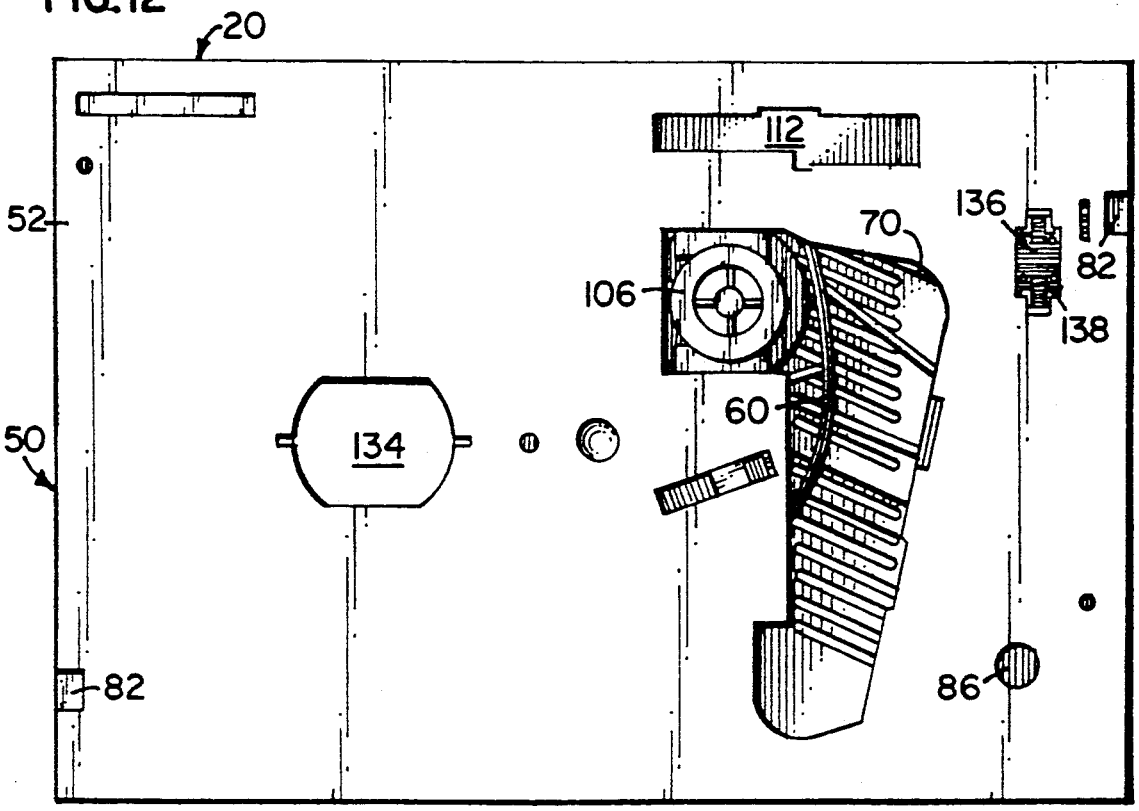
FIG. 12 is a bottom plan view of the cassette of FIG. 11.

Lower plate 52 is provided with an opening 134 (shown in FIG. 12) sized to receive cassette lock 36. Also, as shown in FIG. 12, bottom plate 52 includes an opening 136 sized to receive exposed electrical contact 46. Disposed within opening 136 is, in the preferred embodiment, a connector unit 135*a* which may be produced as a distinct unit and snapped into place against retainers 135*b* and welded or glued or, alternatively, integrally molded with the adjacent housing. The snap-in unit allows for installation- of the tape, ribbon and appropriate resistance element 140. Extending from unit 135*a* are a plurality of second electrical contact members 138 which are disposed to electrically engage exposed electrical contact elements 321 of connector 46 when it is inserted within opening 136. The electrical contact elements 138 include a pair of opposing convex contacts extending from a base via planar elements. The planar elements provide a spring to maintain the convex contacts biased to a particular spacing and are in electrical communication with any desired circuit elements carried by cassette 20. .In the preferred embodiment, as shown in FIGS. 11 and 16, the electrical circuit elements include a resistor 140 which is connected across electrical contact elements 138. Of course, a capacitor, inductor or even active circuits could be connected to the contacts and the number of contacts could likewise be increased to provide power or other electrical information paths. The resistance of resistor 140 is selected to indicate a characteristic of the cassette 20 as will be described.

The cassette 20 further includes a sensing element in the form of a switch including a spring 142 having a free end 143 disposed to abut spool 62. A fixed end 144 of spring 142 is electrically connected by means of an electrical conductor 145 to the circuit contacts 138. As shown in FIG. 11, the spring 142 moves in a predetermined path A to a position (indicated by phantom lines) when the spool has reached a predetermined diameter resulting from consumption of tape. A stationary contact element in the form of an electrically conductive hollow rod 146 is disposed on a post 147. Hollow rod or sleeve 146 is disposed such that it is in electrical contact with electrically conductive spring member 142 when it reaches its predetermined position shown by the phantom line in FIG. 11. Electrically conductive post 146 is connected by means of a conductor 148 to electrical contact elements 138. It can be seen that when the spring is in contact with posts 146, an electrical short is created across resistor 140.

With cassette 20 aligned with machine 10 such that notches 82 are aligned with posts 83 and pin 38 is within pin hole 86, cassette 20 is in proper alignment with the machine 10 and may be placed in its proper position such that platen 28 and head 34 are received within opening 80 with the tape and ribbon disposed between platen 28 and head 34. Further, with cassette 20 properly aligned and in the aforedescribed position, the exposed electrical connector elements 321 of connector 46 are received within opening 136 and are in electrical communication with cassette electrical connectors 138. Also, platen tab 110 is received within female sprocket 12. Additionally, knife blades 281, 282 is,.received within opening 112. With bottom plate 52 of a cartridge 20 urged against the top surface of machine plate 22, switch push button 42 will be depressed. Also, with the cassette in this position, cartridge lock 36 may be turned 90° from the position shown in FIG. 4 such that its rounded edges 36' are received overlying side edges 134' of opening 134 to thereby capture bottom plate 52 between the machine plate 22 and cartridge lock 36 (as shown in FIG. 16).

Figure 10:
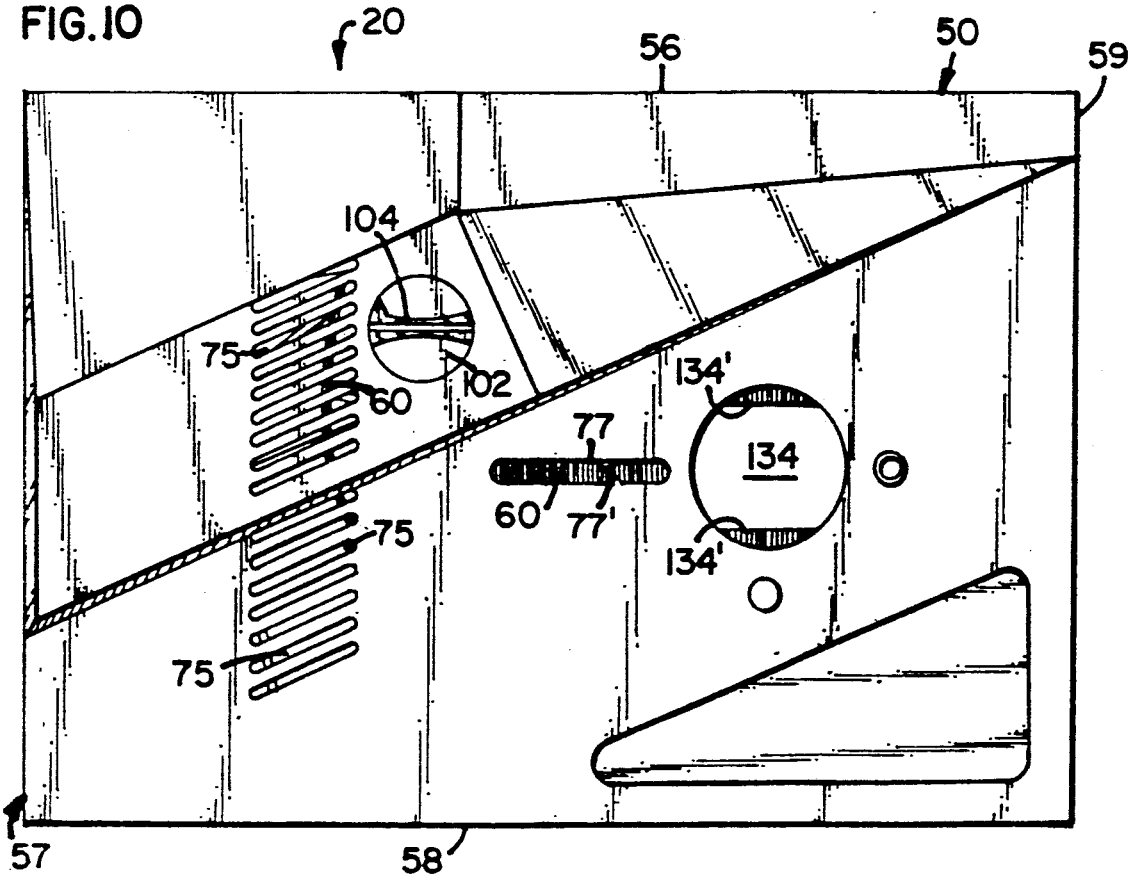
FIG. 10 is a top plan view of the cassette of FIG. 9.

Shown most clearly in FIG. 10, the upper plate 54 is provided with a plurality of vent openings 75. Vent openings 75 are disposed above the intended position of thermal head 34. Additionally, a slot 77 is formed in upper plate 54 projecting radially away from opening 134. Slot 77 enables a user to visually determine the amount of tape left on spool 62. A fixed indicator needle 77' visually informs a user when tape supply is low.

The foregoing description of cassette 20 is a description of a first preferred embodiment. In the embodiment, the cassette includes the image-carrying ribbon 70 and the image-receiving tape 60. The image-receiving tape 60 is intended to receive and image by means of a printing substance transferred from the image carrying ribbon 70 to the image-receiving tape. This process is known as thermal transfer printing. The transfer occurs by reason of thermal head 34 being selectively heated and thereby melting a point on the ribbon 70 onto the receiving surface of the tape 60. The head is a thermal head having a plurality of individually controlled pixels disposed in an array perpendicular to the direction of travel of the tape and ribbon. In a preferred embodiment, the head 34 will have 448 pixels disposed in a density of about 400 pixels per inch. The circuitry of the machine 10 can individually heat each of the pixels so that any possible permutation of the pixel array may be heated to transfer the image of the permutation to the receiving tape by melting the permutation from the ribbon to the receiving tape. It will be appreciated that thermal heads such as head 34 and circuitry for controlling the heads form no part of this invention per se and are described to facilitate an understanding of the novel cassette 20 and head control apparatus 24.

In addition to the first preferred embodiment described above, the present invention is suitable for use where the image-receiving tape receives the image by directly "burning" an image from the head to the receiving tape. This process is known as direct thermal printing. In this embodiment, the spool of ribbon 70 is not needed and may simply be eliminated from the cassette.

3. Detailed Description of Head Control Apparatus 24

A. Frame and Mounting

With particular reference to FIGS. 2, 3, 5–8, the head control apparatus 24 includes a hollow box shaped frame 200 including a main frame portion 202 and a bottom frame plate 204. The bottom plate 204 is attached to the main frame portion 202 by a plurality of screws such as screw 206. The upper surface 203 of the main frame portion 202 opposes the inner surface of machine plate 22. Cassette guide pin 38 extends through opening 39 in main frame portion 202 and is secured to the bottom frame plate 204 by means of a screw 139 (shown only in FIG. 8).

B. Thermal Head Assembly

A thermal head assembly 208 is carried by frame 200. Assembly 208 includes a thermal transfer head 34 carried by a thermal head bracket 210. Bracket 210 comprises a head mounting plate 211 and a cam surface 212. Cam surface 212 is spaced from mounting plate 211 by spacing plate 213 which includes opposing flanges 214 having axially aligned holes therethrough defining a pivot axis X—X. Cam surface 212 is spaced away from mounting plate 211 and is disposed at an angle to the plate. Plate 211 extends radially away from the axis X—X with the face of plate 211 being generally parallel to that axis. Thermal head 34 is attached to mounting plate 211 by a plurality of screws 215. Precise alignment of thermal head 34 relative to the axis X—X can be adjusted by turning head adjust screws 216. The pixel elements of head 34 are connected to the circuitry of machine 10 by means of a connector cable 218 which is fastened to head 34 by mating connector elements 219. Further, thermal head 34 includes a metallic body which is preferably grounded by means of a grounding cable (not shown).

A shaft 222 is provided extending between the holes of aligned flanges 214. Snap rings 224 and washers 225 connect the thermal head bracket 210 to shaft 22 such that bracket 210 is freely rotatable on shaft 222. Shaft 222 is mounted to the frame 200 by passing the shaft 222 through aligned openings 221, 221' in the main frame portion 202 and bottom frame plate 204. Main frame portion 202 includes an opening 205 sized to receive the thermal head bracket 210 such that the bracket 210 is freely pivotable about shaft 222 when it is mounted to the frame 200.

Figure 3:
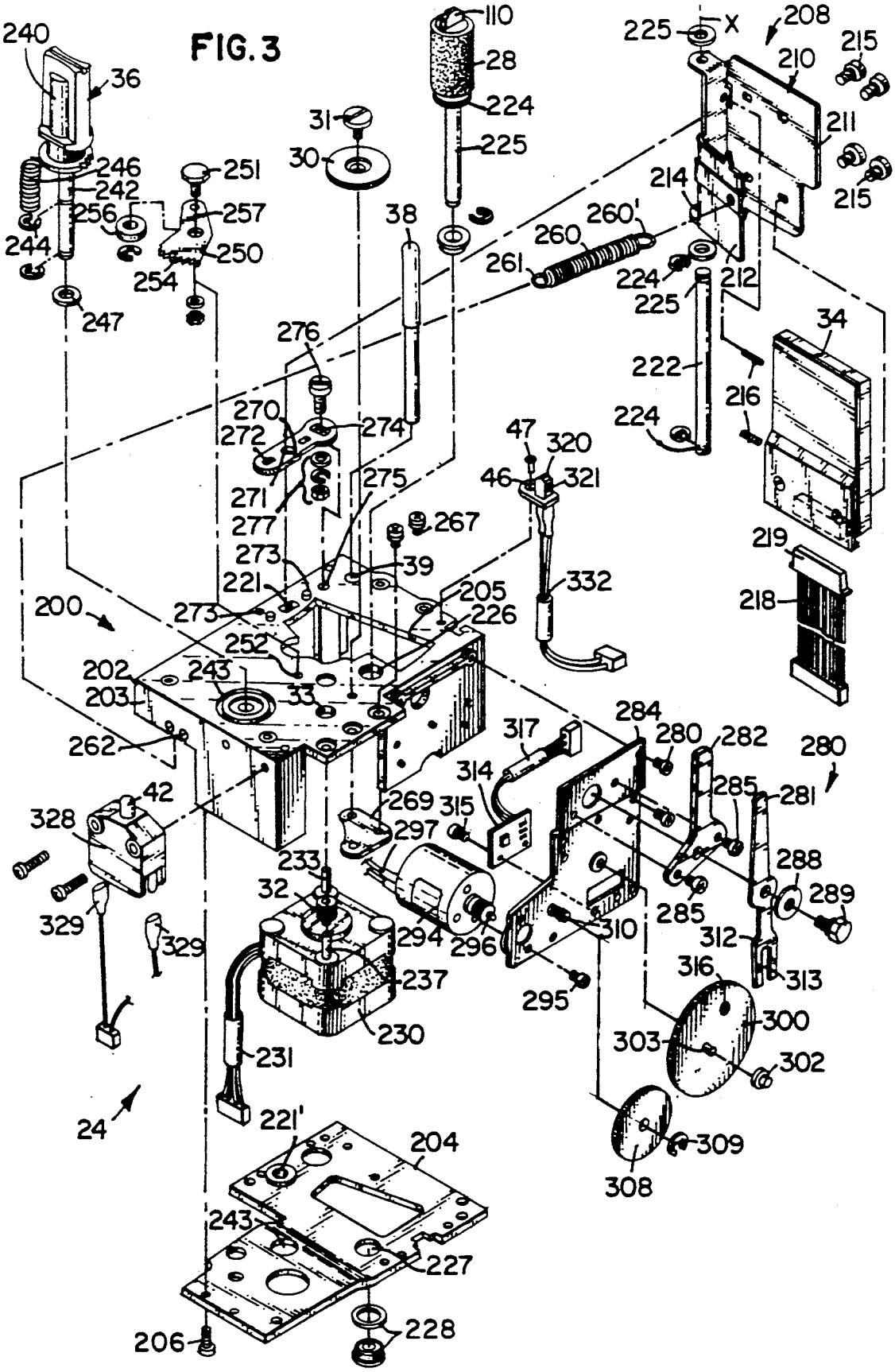
FIG. 3 is an exploded view of the head control apparatus of FIG. 2.

Exact positioning of axis X—X is attained through an eccentric lever 270. As best shown in FIG. 3, shaft 225 extends through an elongated hole 221 in main frame portion 202. A hole 271, sized to receive shaft 222, is formed in lever 270 with shaft 225 extending through hole 271. Eccentric lever 270 includes linearly aligned and spaced apart elongated slots 272. Protruding upwardly from main frame portion 202 are two linearly spaced apart pins 273 disposed to be received within slots 272 when shaft 225 extends through hole 271 and hole 221. An end of lever 270 includes a transverse elongated slot 274 which is aligned with a hole 275 formed through main frame portion 202. An eccentric screw 276 passes through slot 274 and hole 275 and is pivotably secured to the main frame portion 272 by means of a washer and nut assembly 277. Since screw 276 is an eccentric screw, rotational movement of screw 276 causes lever 270 to move linearly in the direction of its aligned slots 272. This linear movement results in angular displacement of shaft 222 such that the precise alignment of axis X—X can be adjusted.

C. Platen and Drive Assembly

The platen 28 includes a gear 224 disposed on an end of platen 28 opposite drive tab 110. A platen shaft 225 extends axially away from gear 224. Shaft 225 is rotatably received within aligned openings 226 and 227 of main frame portion 202 and bottom frame plate 204, respectively. The terminal end of shaft 225 is journaled for rotation within opening 227 by shaft end attachment 228. Shaft 225 is also journaled for rotation within opening 226.

A motor 230 is provided mounted on frame 200. The motor 230 includes drive gear 32 extending through an opening 33 in main frame portion 202. The motor is secured to the main frame by a plurality of nut and spring washer assemblies (not shown) received on threaded studs 233 extending through holes in the main frame portion 202. A connector cable 231 connects the motor 230 to machine circuitry.

Motor 230 is a rotary digital actuator which, on receipt of a signal, rotates in discrete angular displacements.

Motor drive gear 32 is operably connected to platen gear 224 by means of a intermediate idler gear 30. Idler gear 30 is rotatably secured to main frame portion 202 by means of an idler gear screw 31 received within an idler gear adjust plate 269. Idler gear adjust plate 269 is provided with the plate 269 secured to the main frame by a plurality of screws such as screw 267. Screw 31 is receiving through main frame 202 into plate 269.

Figure 7:
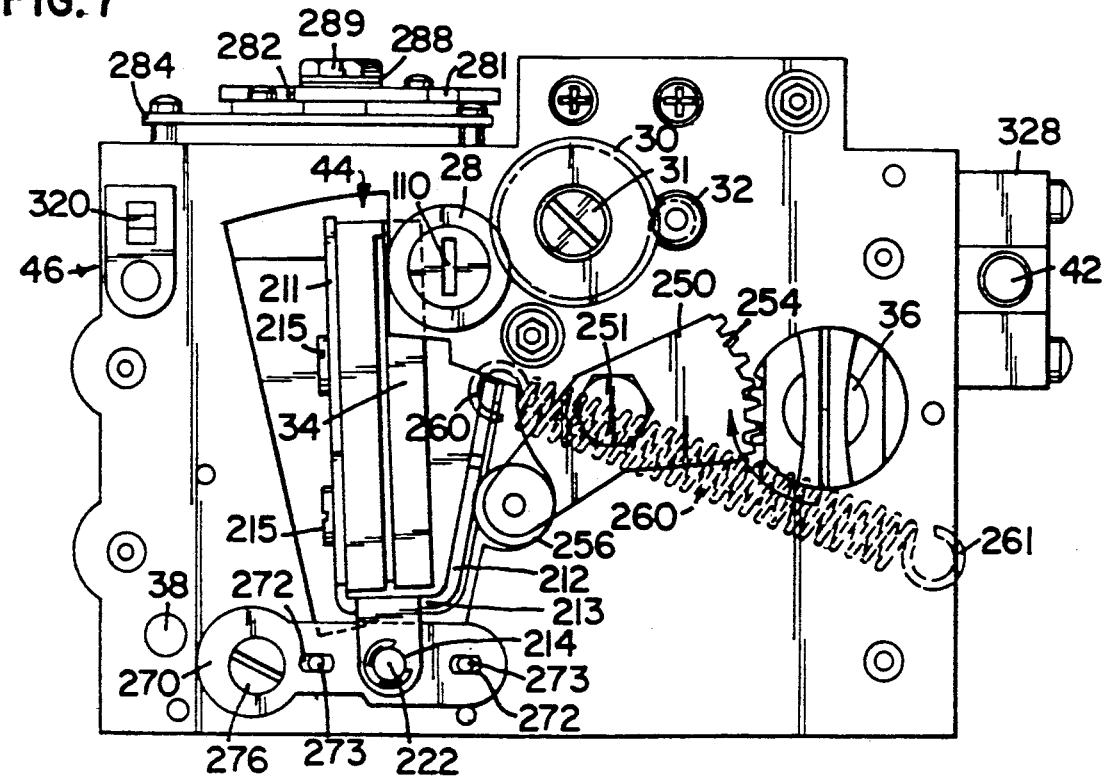
FIG. 7 is the view of FIG. 6 showing the head control apparatus in a second position.

With reference to FIG. 7, upon actuation of motor 230, motor drive gear 32 rotates in a clockwise direction urging idler gear 30 to rotate in a counterclockwise direction which, in turn, rotates platen 28 in a clockwise direction to advance a tape passed head 34.

D. Head Position Control

As mentioned, thermal head assembly 208 includes the mounting bracket 210 which is pivotable about shaft 222. The cassette lock 36 includes a knob 240, an axially aligned gear 241 and an extending shaft 242. Shaft 242 is receiving through aligned openings 243 in main frame plate 202 and bottom frame plate 204. The shaft 242 is retained within the frame 200 by means of lock rings 244.

Figure 8:
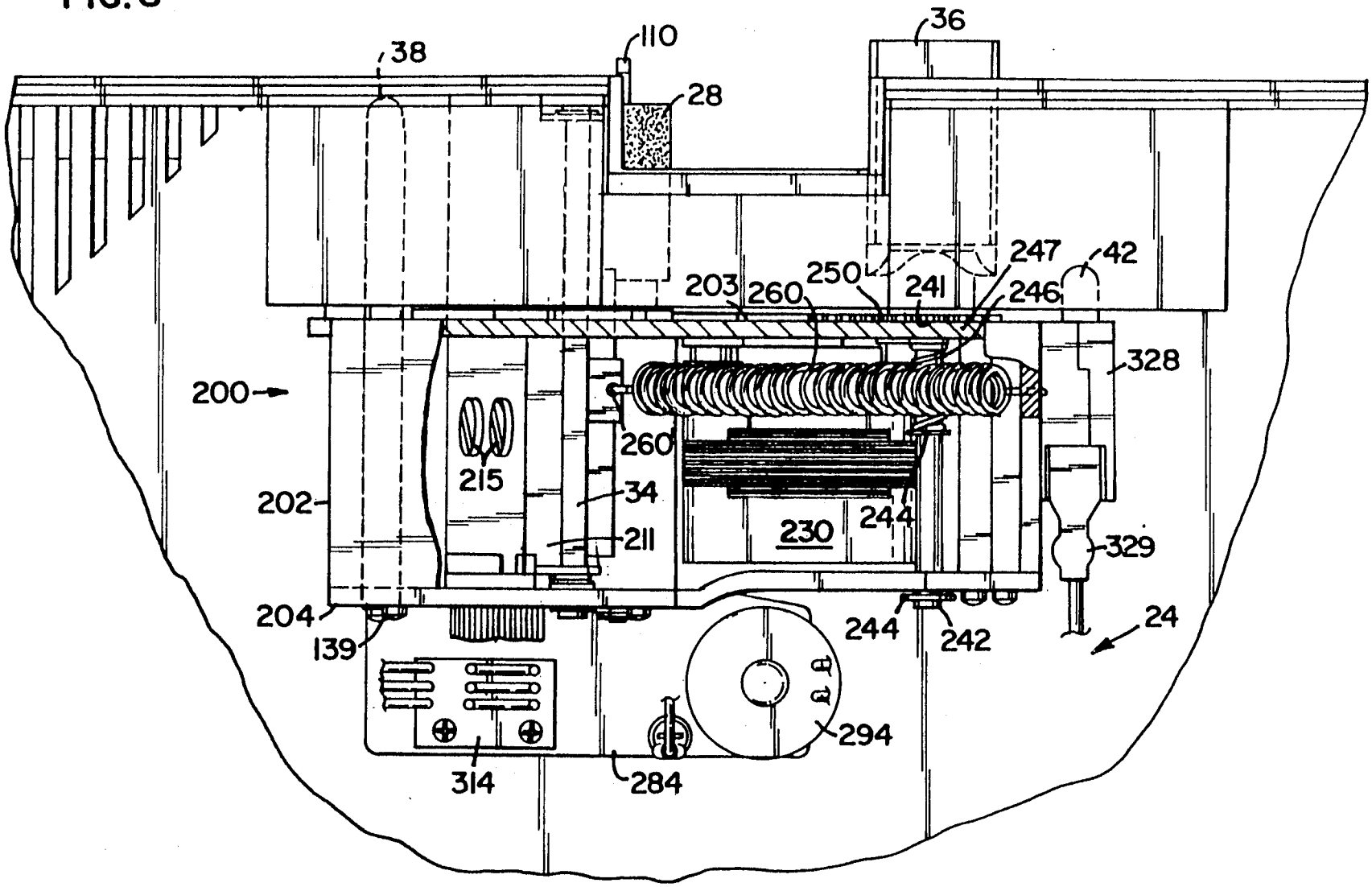
FIG. 8 is a side elevation view of the head control apparatus taken from a side thereof opposite that shown in FIG. 5.
Figure 9:
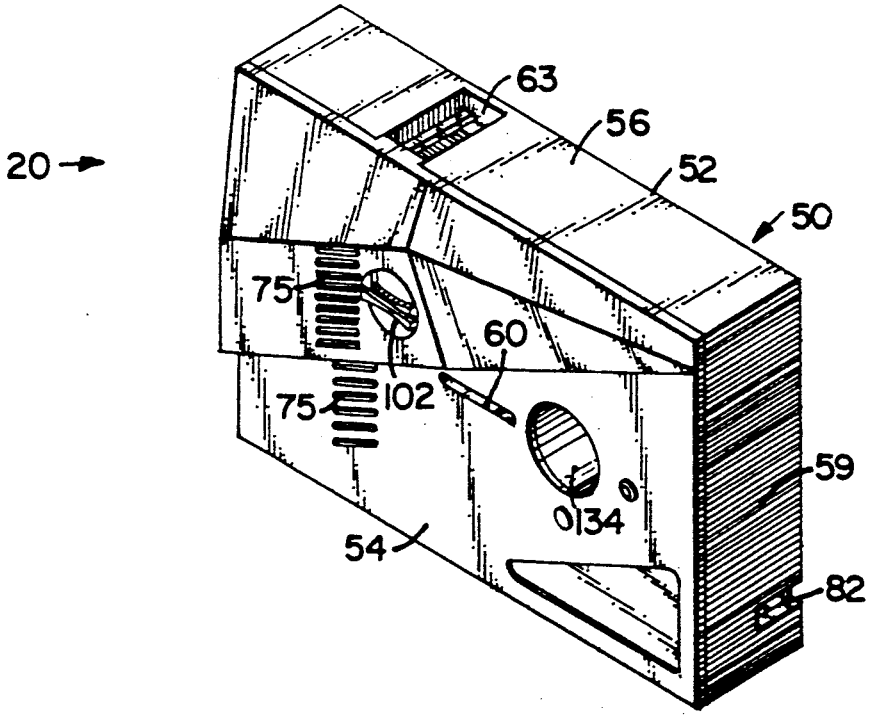
FIG. 9 is a perspective view of a cassette of the present invention.

Shaft 242 is axially movable within aligned holes 243. A release spring 246 is received within frame 200 and carried on shaft 224 with spring 246 disposed between main washer 247 and lock ring 244 (as best shown in FIG. 8). Spring 246 urges set lock 36 downwardly (when viewed in the view of FIG. 8) with gear 241 abutting an upper surface of main frame portion 202.

Disposed between cassette lock 36 and thermal head assembly 208 is a release lever including an offcentered lever 250. A central portion of lever 250 is pivotably secured to the upper surface of main frame portion 202 by means of a lever screw 251 extending through hole 252. A first end of lever 250 includes gear teeth 254 selected to mesh with the gear teeth of gear 241. An opposite end of gear 250 (and off-center of linear alignment with gear teeth 254) carries a rotatable cam follower 256 carried on a pin 257 by means of a lock ring 258. Cam follower 256 is disposed to abut cam surface 212.

A head return spring 260 is provided having a first end 260′ connected to cam surface 212 and a second end 261 secured to main frame portion at location 262. With the assembly so described cassette lock 36 can be rotated to the position shown in FIG. 7. In this position, cam follower 256 is not acting against cam surface 212 and head 34 abuts platen 28. When it is desired to place a cassette onto the machine or remove a cassette from the machine, cassette lock 36 is rotated 90° counterclockwise (when viewed in FIGS. 6 and 7) to the position of FIG. 6. Upon movement of the cassette lock 36, cam follower 214 urges cam surface 212 with head 34 pivoting about axis X—X away from platen 28 to the position shown in FIG. 6. With the head 34 spaced from platen 28, a clear pathway 44 is defined and a cassette may be easily removed or replaced onto the machine without the platen 28 and head 34 interfering with the tape and ribbon of the cassette. To insure that there is no interference from the platen 28, cassette biasing member 120 (previously described in detail) urges the tape away from platen 28 in the event it might stick or adhere to the platen 28.

E. Tape Termination Apparatus

A tape termination assembly 280 provided for terminating a tape after it has received an image from head 34. Termination assembly 280 includes a movable knife 281 and a fixed knife 282. Fixed knife 282 is carried on a cutter bracket plate 284 by means of screws 285. Plate 284 is secured to main frame portion 202 by means of screws 286. A grounding conductor (not shown) connects plate 284 to grounds.

Movable knife 281 is pivotably secured to fixed knife 282 by means of washer 288 and screw 289. So secured, knife 281 may be moved toward and away from fixed knife 282 with the cutting edges of the opposing knives terminating a tape between them.

A cutter motor 294 is secured to plate 284 by means of screws 295 with a cutter drive gear 296 extending through plate 284. Electrical leads 297 connect cutter motor 294 with circuitry of machine 10. A blade drive gear 300 is rotably mounted on plate 284 to rotate about its axis. A roller 302 is mounted on a pin 303 extending from drive gear 300 with roller 302 spaced from the axis of rotation of gear 300.

A cutter idler gear 308 is mounted onto plate 284 by lock ring 309 received on a post 310. The idler gear 308 operably connects blade drive gear 300 to cutter drive gear 296. Cutter blade 281 includes an extending lever arm 312 having an opened elongated slot 313 which receives roller 302. As gear 300 rotates about its axis, roller 302, traveling in its orbit about the axis of gear 300, reciprocally moves within the slot 313 causing knife 281 to move back and forth about its pivot axis.

A cutter home position sensor 314 is secured to plate 284 by screws 315 to detect the presence of a target 316 on gear 300. Sensors such as sensor 314 are known in the art and form no part of this invention per se. Use of such sensors to detect targets such as target 316 is known. With the sensor 314 and the target 316 on the gear 300, the positioning of the blade 281 relative to fixed blade 282 can be determined. The sensor is connected through a conductor 317 to circuitry of the printing machine 10.

F. Additional Components

Electrical connector 46 is mounted on the top surface of main frame portion 202 by means of a screw 47. The connector 46 includes a post 320 of dielectric material having electrically conductive contacts (such as contact 321) disposed on opposite sides of post 320. Contacts 321 are connected through electrical conductors 322 to circuitry of the printing machine 10. Of course, post 320 could also have a plurality of contacts on each face for additional electrical signals.

A switch 328 is mounted on a side of main frame portion 202 with push button 42 exposed through plate 22. Switch 328 is an on/off switch activated by button 42. The switch is connected by electrical conductors 329 to the circuitry of the machine 10. In a preferred embodiment, switch 328 interrupts power to the machine when button 42 is not depressed. Thereby, the switch 328 acts as a safety element such that the machine cannot be operated unless a cassette is positioned on the machine depressing button 42.

4. Operation of Apparatus

Figure 6:
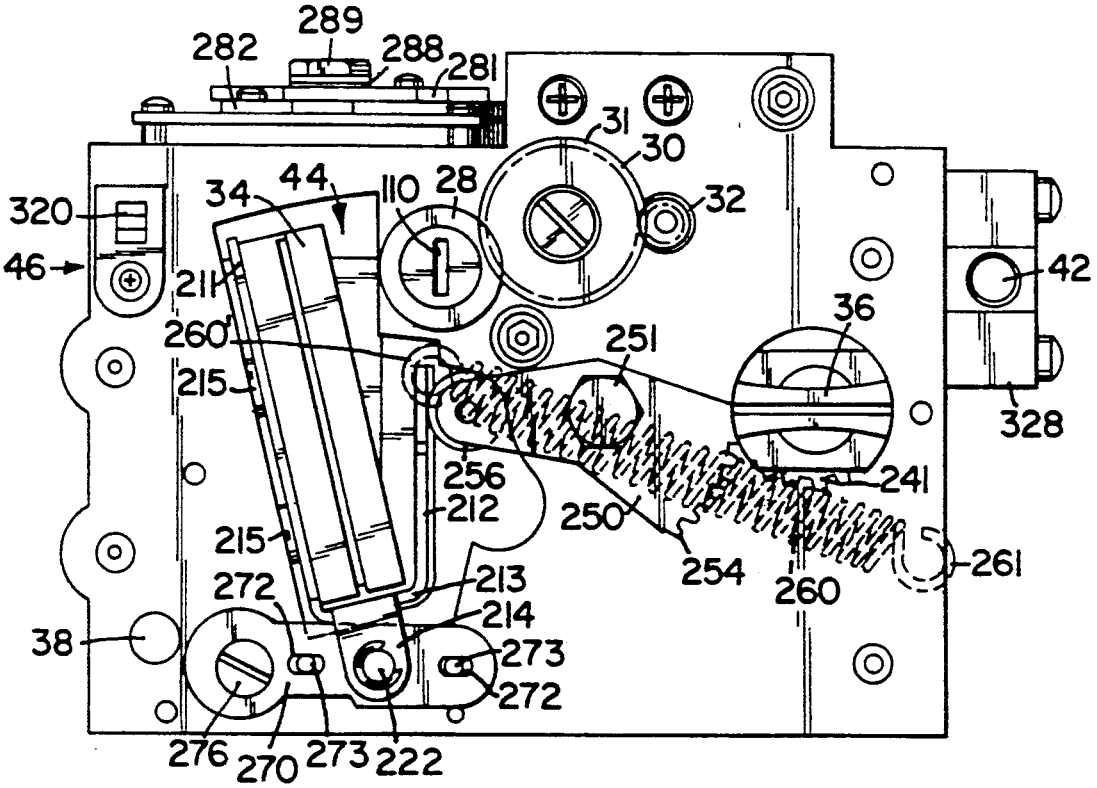
FIG. 6 is a top plan view of the head control apparatus of FIG. 2 showing a thermal head in the first position.

With a structure of the printing machine 10 and the novel tape cassette 20 and head control apparatus 24 described, a description of the operation of the apparatus will now be provided With reference to FIG. 4, the head control apparatus 34 is shown in an idle position when a tape cassette 20 is not inserted onto the top of machine plate 22. In the idle position, the thermal head 34 is spaced from platen 28 to define a tape receiving pathway 44 therebetween. When in this position, the cam follower 256 is urging the cam surface 212 to deflect against the urging of spring 260 as shown in FIG. 6.

When it is desired to use machine 10, a tape cassette 20 is positioned on machine plate 22 with guide pin 38 received within cassette guide pin hole 86. As the machine is inserted, notches 82 are aligned with post 83. With the cartridge 20 properly aligned on plate 22, the cartridge 20 is pushed by the operator to urge push button 42 downwardly. With cartridge 20 held down tightly against surface 22, cassette lock 36 is engaged by the operator and rotated 90° to the right (when viewed in FIG. 4). With this rotation, the rounded edges 36' of cassette lock 36 capture edges 134' of the cassette between the rounded edges 36' and the machine plate 22. In moving over the edges 134', the cassette lock 36 moves axially against the urging of spring 246.

With the cassette 20 locked onto machine plate 22, the apparatus may now be used by an operator to produce a tape with a desired printed image. When the operator rotates the cassette to the position shown in FIG. 7, the cam follower 256 is moved to a position where it is no longer urging cam surface 212. Therefore, a spring 260 can urge the head 34 toward platen 28. The tape and ribbon are thereby caught between the platen and the head.

When the tape cassette 20 is installed as described, the machine is ready for use by an operator. The operator selects a desired printing mode and enters an input through keys 14. The input may be a command for the apparatus to print a letter. In the event the command is given, the particular letter is known by the electronics of the machine 10 to represent a controlled arrangement of dots generated by energizing pixels on head 34 as a tape and ribbon advance passed the head 34. When the command to print a letter is given, the step motor 230 turns drive gear 32. Accordingly, platen 28 advances the tape pass head 34. The platen tab 110 received within female sprocket 102 of tape cassette 20 turns with platen 28. Rotation of female sprocket 102 drives take-up spool 76. Rotation of spool 76 advances and takes up the ribbon 70. Rotation of platen 28 advanced the tape 60.

After a letter is printed, step motor 230 operates the platen 28 to advance the tape 60 a predetermined amount to a point to began printing of a next inputted letter. Simultaneous with the advancement of the tape, the step motor advances the take-up spool so that fresh portions of both tape and ribbon are opposing the pixels of the head.

After a desired completed image has been produced onto the tape, the step motor 240 receives a signal to advance the tape out of outlet 63. With the tape so advanced, motor 294 receives a signal through conductors 297 to rotate gear 296 and consequently move gear 300 with blade 281 moving toward blade 282 to terminate the tape. After termination has occurred, the motor 294 operates to automatically rotate and advance the cutting blade 281 away from the stationary blade 282. As the blade approaches its position fully displaced from blade 282, the positioning of the target 316 is detected and through conductors 317 sends this information to the electronic controls of the machine 10. Upon detection of the target, the motor 294 receives a signal to discontinue rotation.

With the operation completed and the desired tape produced, the operator rotates the cassette lock 90° counterclockwise to the position shown in FIG. 4. With this position, the cam follower 256 urges cam surface 212 against the urging of spring 260. Accordingly, head 34 is pivoted away from platen 28. As head 34 pivots away from platen 28, tape cassette biasing member 120 urges the tape away from the platen. At this position, the cartridge can be removed by the operator with the spaced positioning of the head and platen permitting quick remove of the cassette 20 without damage to the tape within the cassette.

When a cassette 20 is in position, the exposed electrical connectors 138 of the cassette are in electrical communication with electrical contacts 321 of electrical connector 46. As a result, the resistor 140 of the cassette is in electrical communication with the circuitry of the machine 10. Cooperating with the circuitry of the machine, the resistor 140 is selected to identify the type and size of tapes and ribbon carried by the cassette. By varying the resistance of resistor 140, a resistance of known value can identify a tape of predetermined width. Or, the resistance might indicate what type of tape is carried by the cassette (for example, clear tape, white tape or the like) as well as the type of ribbon. With these known attributes communicated to the circuitry of the machine through resistor 140, the machine can adjust the energy delivered to the pixels of thermal head 34. For example, with certain types of tape and ribbon combinations, a high heat energy is required to effect image transfer. However, for a different tape/ribbon combination, a lower energy would be preferable. By knowing the attributes of the tape carried by the cassette, the machine can automatically adjust the energy of the thermal head 34 such that it is an optimal energy. Similarly, by knowing the width of the tape, the machine can adjust the size of the lettering being generated by the thermal head for a tape of known width.

In function, the resistance (or other parameter) measured from the cartridge is amplified and converted to an 8 bit binary digital output which is fed to a microprocessor. The binary value is compared to information in a look up table and triggers appropriate adjustments in the operation of the machine. In addition, a binary value can be assigned to special functions such as triggering a diagnostic test, etc.

A lack of resistance, etc. (open circuit) is preferably used to lock the machine function, as a safety feature.

As a tape is consumed and approaches a tape empty situation, spring 142 moves to the position where it is in contact with post 146. In this position, a short is created across resistor 140 which is detected by the machine circuitry and can be communicated to the operator indicating to the operator that he is out of tape.

From the foregoing detailed description of the present invention, it has been shown how the invention has been attained in a preferred manner. However, modifications and equivalents of the disclosed concepts such as readily occur to those skilled in the art are intended to be included in the scope of this invention. Thus, the scope of the invention is intended to be limited only by the scope of the claims as are, or may hereafter be, appended hereto.

We claim:

1. A tap cassette for a printing machine having an exposed tape driving means, an exposed transfer head for transferring an image from an image carrying tape to an image receiving tape, and a machine circuitry including exposed first electrical connector elements in electrical communication with said machine circuitry and said machine circuitry including means for receiving a signal from said first electrical connector elements and comparing said signal to a memory to adjust operation of said printing machine, said cassette comprising:

a housing;

a first spool disposed within said housing and carrying an image receiving tape;

first guide means for guiding said tape from said first spool with said tape following a first predetermined path;

said first path selected for said tape to pass a predetermined location, said predetermined location selected proximate said transfer heat when said cassette is mounted on said printing machine in a predetermined position;

drive coupling means for operably engaging said driving means when said cassette is in said predetermined position with said drive coupling means advancing said tape upon operation of said driving means; and electrical circuit means carried by said cassette and having exposed second electrical connector elements disposed to electrically engage said first electrical connector elements when said cassette is in said predetermined position with said circuit means and said machine circuitry cooperating to define a completed electrical circuit;

said electrical circuit means including at least one fixed electrical circuit element carried by said cassette, said element preselected to return a fixed one of a variety of possible electrical signals to said machine circuitry with said one signal indicative of a characteristic of said cassette said element preselected for said machine circuitry to perform desired adjustment in operation of said printing machine with response to said signal.

2. A tape cassette according to claim 1 wherein said circuit element is preselected to cooperate with said machine circuitry to indicate a type of tape carried on said first spool.

3. A tape cassette according to claim 3 wherein said tape carried on said first spool is selected from one of a plurality of tape widths, said at least one element selected in response to said tape width.

4. A tape cassette according to claim 1 wherein said electrical circuit means further includes sensing means for sensing the presence of tape on said first spool.

5. A tape cassette according to claim 4 wherein said sensing means includes a switch means having a movable contact element movable in response to an amount of tape on said first spool, a stationary contact element disposed to be electrically engaged by said movable contact element when said movable contact element has moved to a point indicating a predetermined amount of tape remaining on said first spool.

6. A tape cassette according to claim 5 wherein said movable contact includes a spring having a stationary first end and a free second end, said free second end disposed abutting said tape on said first spool and resiliently urged against said tape, said free end moving in a predetermined path in response to a reduction of diameter of tape on said first spool, said stationary contact element disposed at a predetermined point along said path.

7. A tape cassette according to claim 6 wherein said circuit element is a resistive element.

8. A tape cassette according to claim 1 wherein said cassette further comprises a second spool disposed within said housing and carrying an image carrying ribbon;

second guide means for guiding said ribbon from said second spool with said ribbon following a second predetermined path, said second predetermined path selected for said ribbon to oppose said tape in said predetermined location;

said drive coupling means including means for advancing said ribbon upon operation of said driving means.

9. A tape cassette according to claim 8 wherein said drive coupling means includes a first rotatable member with means for releasably connected said first rotatable member to said driving means when said cassette is in said predetermined position; a take-up spool mounted in said cassette for taking up said ribbon after said ribbon passes said predetermined location; and means for operably connecting said first rotatable member to said take-up spool with said take-up spool rotating in response to rotation of said first rotatable member.

10. A tape cassette for a printing machine having means for mounting said cassette on said machine in a predetermined position and having a machine circuitry including exposed first electrical connector elements in electrical communication with said machine circuitry and said machine circuitry further having means for receiving a signal from said first electrical connector elements and comparing said signal to a memory to adjust operation of said printing machine, said cassette including electrical circuit means carried by said cassette and having exposed second electrical connector elements disposed to electrically engage said first electrical connector elements when said cassette is in said predetermined position, said electrical circuit means including at least one fixed electrical circuit element carried by said cassette said element preselected to return a fixed one of a variety of possible electrical signals to machine circuitry with said signal indicative of a characteristic of the cassette, said element preselected for said machine circuitry to perform a desired adjustment in operation of said printing machine after comparing said signal to said memory.

11. A tape cassette according to claim 10 wherein said circuit element is preselected to cooperate with said machine circuitry to indicate a type of tape carried by said cassette.

12. A tape cassette according to claim 10 wherein said circuit element includes a resistor having a resistance selected to indicate a characteristic of said cassette.

13. A tape cassette according to claim 12 wherein said cassette carries a tape selected from one of a plurality of predetermined tape widths, said resistance selected in response to said tape width.

14. A tape cassette according to claim 10 wherein said electrical circuit means includes sensing means for sensing the presence of tape in said cassette.

15. A tape cassette according to claim 14 wherein said tape includes a dimension which decreases as tape is used from said cassette, said sensing means including a switch means having a movable contact element movable in response to a change in said dimension, a stationary contact element disposed to be electrically engaged by said movable contact element when said movable contact element has moved to a point indicating a predetermined amount of tape remaining in said cassette.

16. A tape cassette according to claim 15 wherein said movable contact includes a spring having a stationary first end and a free second end. Said free second end disposed abutting said tape and resiliently urged against said tape, said free end moving in a predetermined path in response to utilization of said tape, said stationary contact element disposed at a predetermined point along said predetermined path.

17. A combination tape cassette and printing machine comprising:

(A) a printing machine having:

(i) means for mounting a cassette on said machine in a predetermined position;

(ii) a machine circuitry including exposed first electrical connector elements in electrical communication with said machine circuitry, said machine circuitry including means for receiving a signal from said first electrical connector elements and comparing said signal to a memory to adjust operation of said printing machine;

(B) a cassette including electrical circuit means carried by said cassette and having exposed second electrical connector elements disposed to electrically engage said first electrical connector elements when said cassette is in said predetermined position, said electrical circuit means including at least one fixed electrical circuit element carried by said cassette, said element preselected to return a fixed one of a variety of possible electrical signal to said machine circuitry with said signal indicative of a characteristic of said cassette, said element preselected for said machine circuitry to perform a desired adjustment in operation of said printing machine after comparing said signal to said memory.

* * * * *

UNITED STATES PATENT AND TRADEMARK OFFICE

CERTIFICATE OF CORRECTION

PATENT NO. : 5,078,523

DATED : January 7, 1992

INVENTOR(S) : Thomas K. McGourty, Lawrence F. McGourty and Kevin B. McGourty

It is certified that error appears in the above-identified patent and that said Letters Patent is hereby corrected as shown below:

In Column 1, line 14, after the word "abandoned.", insert

--Also filed on even date herewith are related U.S. design patent applications Serial Nos. 164,116 and 164,113.-- .

In Column 6, line 40, after the word "installation", delete "-" .

In Column 7, line 24, "12" should read --102-- .

In Column 7, line 24, "is,." should read --are-- .

In Column 8, line 47, "22" should read --222-- .

In Column 9, line 2, "272" should read --202-- .

In Column 9, line 43, "passed" should read --past-- .

In Column 9, line 62, "offcentered" should read --off-centered-- .

In Column 10, line 16, "214" should read --256-- .

In Column 11, line 67, "passed" should read --past-- .

UNITED STATES PATENT AND TRADEMARK OFFICE

CERTIFICATE OF CORRECTION

PATENT NO. : 5,078,523

DATED : January 7, 1992

INVENTOR(S) : Thomas K. McGourty, Lawrence F. McGourty and Kevin B. McGourty

It is certified that error appears in the above-identified patent and that said Letters Patent is hereby corrected as shown below:

In Column 12, line 2, "pass" should read --past-- .

In Column 13, Claim 1, line 27, "tap" should read --tape-- .

In Column 13, Claim 1, line 45, "heat" should read --head-- .

Signed and Sealed this

Seventh Day of September, 1993

Bruce Lehman

*Attest:*

BRUCE LEHMAN

*Attesting Officer*

*Commissioner of Patents and Trademarks*